United States Patent [19]

McMullan

[11] 4,346,489

[45] Aug. 31, 1982

[54] FOLDABLE WATERBED

[76] Inventor: James P. McMullan, 12300 Monarch St., Garden Grove, Calif. 92641

[21] Appl. No.: 155,963

[22] Filed: Jun. 3, 1980

[51] Int. Cl.[3] ..... A47C 27/08

[52] U.S. Cl. ..... 5/451; 5/68; 5/455

[58] Field of Search ..... 5/455, 451, 452, 449, 5/450, 441, 411, 68

[56] References Cited

U.S. PATENT DOCUMENTS

| | | | |
|---|---|---|---|
| 779,576 | 1/1905 | Berryman | 5/451 |
| 3,735,432 | 5/1973 | Kreten et al. | 5/451 |
| 4,042,988 | 8/1977 | Holliday | 5/450 |
| 4,149,286 | 4/1979 | Fogel | 5/451 |
| 4,150,447 | 4/1979 | Miller | 5/452 |
| 4,221,013 | 9/1980 | Echevarria | 5/455 |
| 4,297,755 | 4/1981 | Mollura | 5/451 |

FOREIGN PATENT DOCUMENTS

| | | | |
|---|---|---|---|
| 608951 | 2/1979 | Switzerland | 5/455 |
| 1545806 | 5/1979 | United Kingdom | 5/455 |

*Primary Examiner*—Alexander Grosz

[57] ABSTRACT

A flotation mattress comprising an outer jacket of supple flexible sheet plastic having normally flat vertically spaced top and bottom walls and vertical side and end walls and a plurality of elongate bladders of supple flexible sheet plastic with top, bottom, side and end walls arranged within the jacket in parallel side-by-side relationship with each other and slackly filled with water, the dimensions of the related and assembled bladders being substantially the same as the dimensions of the jacket whereby the bladders are captively retained in assembled relationship and are reinforced by the jacket. The jacket has a plurality of elongate, vertical parallel partitions, each occurring between a pair of adjacent bladders and stopping displacement of the bladders within the jacket.

8 Claims, 19 Drawing Figures

Fig. 7.
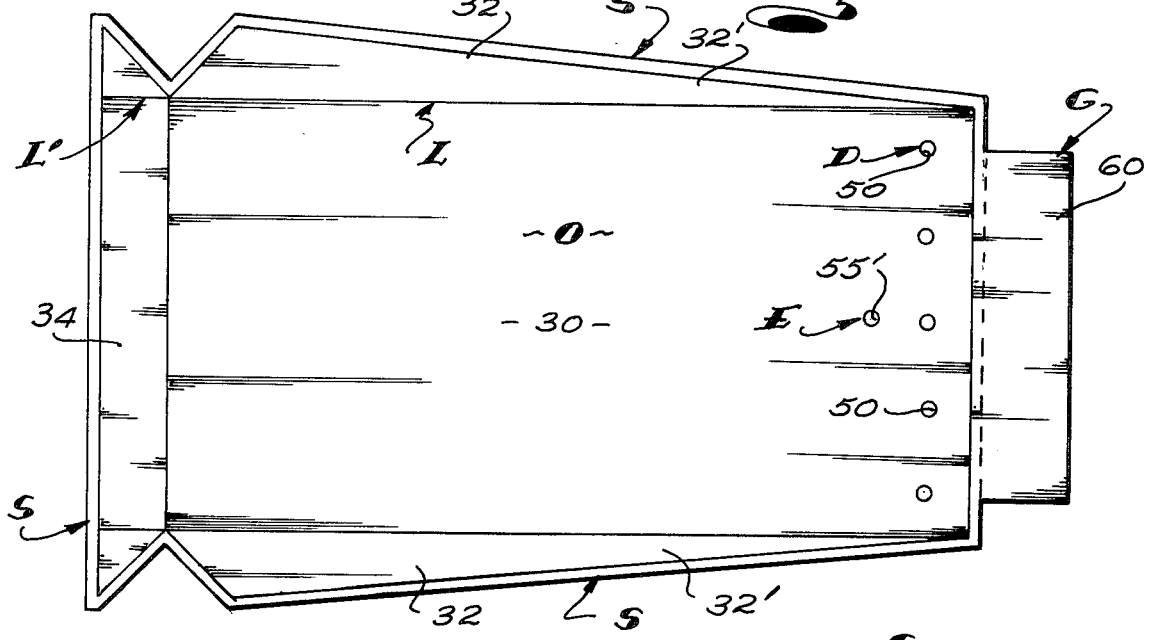
Fig. 8.
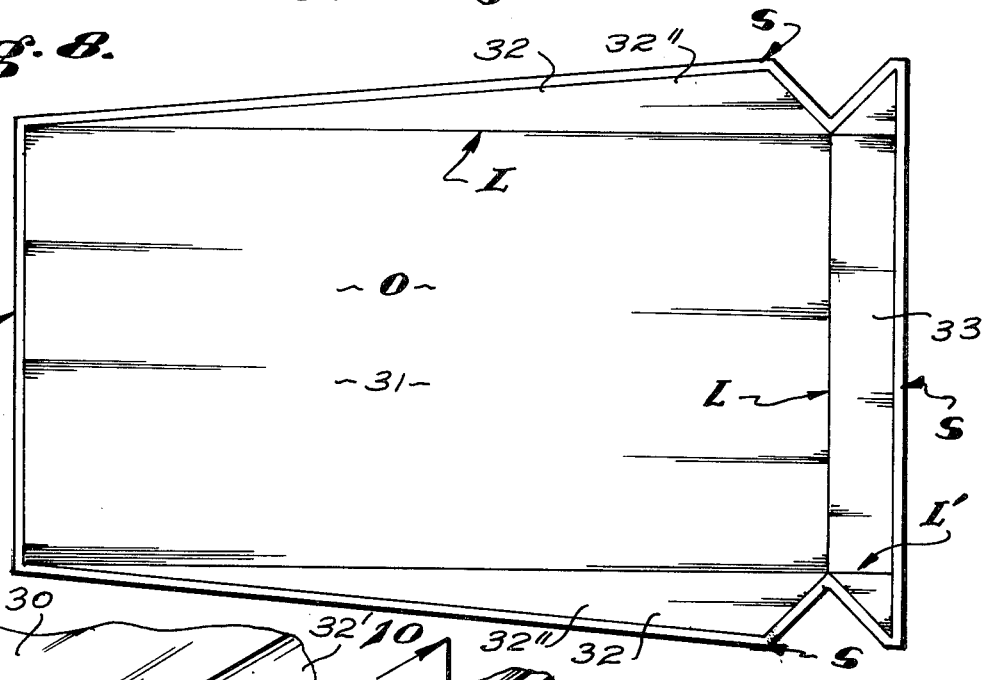
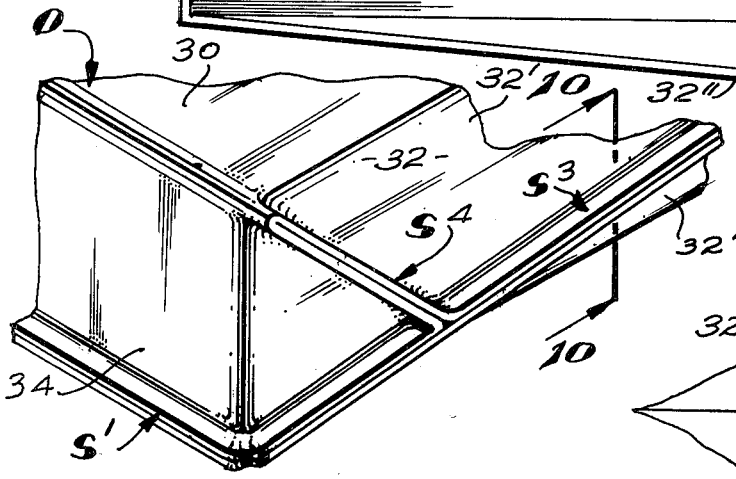
Fig. 9.
Fig. 10.
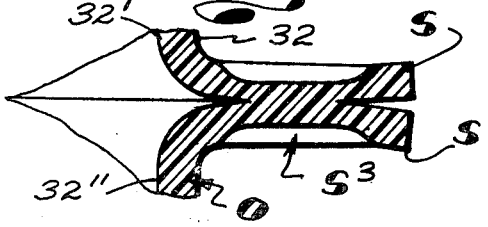

FOLDABLE WATERBED

This invention has to do with a flotation mattress and is particularly concerned with a novel mattress structure for articulated beds.

BACKGROUND OF THE INVENTION

In the art of beds, the most common form of bed comprises an elongate, flat, horizontal, rectangular body supporting mattress of soft, resilient and/or yielding material and an elongate floor engaging bed frame arranged beneath and supporting the mattress above the floor. Such beds have forward head ends and rear foot ends.

One special class of bed, which is widely used in hospitals and the like, includes an articulated mattress supporting frame which is such that it can be operated to elevate the head end of the mattress whereby the head end portion of the mattress is longitudinally and upwardly inclined relative to the remainder of the mattress and so that a person lying or engaged on the mattress is comfortably supported in a semi- or substantially upright sitting position. The ordinary articulated bed of the character referred to above is commonly constructed and operable to elevate and bend or break that portion of its related mattress occurring at and beneath the knees of a person lying on the bed to comfortably elevate and support the legs of that person in an elevated bent condition, when desired.

In the ordinary articulated bed frame, the normally horizontal, rectangular, mattress supporting frame is a sectional structure comprising a head end section, a foot end section and a central or intermediate section. The several sections have laterally extending or transverse forward and rear end edges. The rear edge of the head section and the forward edge of the central section are pivotally connected together on a fixed horizontal axis extending transverse the frame, while the rear edge of the central section and the forward edge of the foot end section are pivotally coupled together on a vertically and longitudinally shiftable transverse axis. The rear edge of the foot end section is free to shift longitudinally and is, in some instances, shiftable vertically.

The ordinary articulated bed frame structure of the character referred to above also includes manually operable or motor driven jack mechanisms related to the head sections of the frames to pivot the forward edges of those sections of the frames up and down. Second and similar jack mechanisms are provided to raise and lower the pivotally connected edges of the central and foot end sections and, if necessary, third similar jack mechanisms can be provided to raise and lower the rear edges of the foot end sections.

In the case of ordinary fiber or plastic foam filled fabric covered mattresses used in combination with articulated bed frames of the character referred to above, the mattresses substantially freely break or bend transversely along lines parallel with the axes between the adjacent sections of the frames to establish the desired mattress configurations.

Further, in the art of bedding, flotation mattresses comprising water filled bladders of supple and flexible sheet plastic have become quite common in recent years and are now recognized as affording support for the human body which is notably superior to that support which is afforded by common fiber or foam plastic filled fabric covered mattresses.

The superior body support afforded by flotation mattresses is such that the use of such mattresses is being recommended and/or required by an ever-increasing number of experts in the fields of medicine and physical therapy.

As a result of the above, in the recent past, efforts have been made to support water-filled plastic bladder-type flotation mattresses on articulated bed frame structures of the character referred to in the preceding and to thereby attain the benefits afforded by flotation mattresses in combination with the benefits afforded by articulated bed frames. Such efforts have met with little or no success.

The lack of successful use of flotation mattresses in combination with articulated bed frames of the character referred to above resides in the fact that ordinary flotation mattresses comprise bladders of soft, supple and flexible sheet plastic with vertically spaced normally parallel horizontal, top and bottom walls and vertical side and end walls about and between the top and bottom walls. The two horizontal walls are established of two sheets of plastic sheet stock and the side and end walls are normally established by vertically downwardly and upwardly turned and suitably cut marginal extensions on the top and bottom walls, which extensions have related edges arranged in lapped engagement with each other and are sealingly fixed together by continuous lines of thermal welding. Accordingly, the side and end walls of such mattresses are characteristically interrupted and divided by welded seams. In addition to the above noted seams, the four vertical corner edges of such mattresses are often established by welded seams.

When thermally welding the seams in the sheet plastic of mattresses of the character referred to above, heat and pressure is applied on and between the plastic sheeting to be welded along weld lines. The applied heat and pressure stretches, draws and causes the plastic material to flow and weld together. The stretching, drawing and/or flowing of the material results in notably reducing the wall thickness of the sheet plastic material adjacent the weld lines and materially weakens the resulting bladder structures adjacent the weld lines.

The above noted weakened areas of the bladders are subject to rupturing and tearing when excessive internal pressures, in the bladders, are encountered.

In addition to the above, thermal welding also tends to cause hardening or embrittlement of the welded material to further weaken the resulting structures.

When water filled flotation mattresses of the character referred to above arre related to articulated bed frames and are caused to be bent or broken along one or more transverse lines by operation of the bed frames, the bending or breaking of the mattresses, in effect, squeezes or pinches off portions of the mattresses, displacing the water adjacent thereto and materially increasing the hydraulic or fluid pressure within the mattresses. In the case of ordinary floation mattresses of the character referred to above, the increased pressures generated within the mattress upon bending or breaking them, as noted above, is sufficient to cause the weakened portions of the mattress structures adjacent the weld lines to rupture or burst. The above rupturing or bursting of such mattresses occurs in spite of the fact that the portions of the mattress which are not weakened by welding or the like are theoretically of sufficient strength to withstand the noted increased pressures.

Attempts to overcome the above noted weaknesses in ordinary flotation mattresses by increasing the wall thickness of the sheet material employed to establish the mattresses and thereby provide a greater amount of material and resulting greater strength at the weld lines, has resulted in mattresses which are not sufficiently supple and flexible, or which are too hard and stiff to afford the sought after and desired body support.

Another shortcoming found in the use of conventional flotation mattresses in combination with articulated bed frames of the character referred to above resides in the fact that when the bed frames are operated to bend or break the mattresses, the unrestricted flow or displacement of the single and large volume of water throughout the planes of the mattresses results in situations where insufficient water is let to remain beneath some portions of the bodies of persons engaged on the mattresses to prevent their bodies from causing the top walls of the mattresses to engage and stop or "bottom out" on the bottom walls thereof; and moves or displaces excessive volumes of water beneath other portions of the bodies of the persons to elevate those portions of their bodies, whereby desired and sought after body support is unattainable.

OBJECTS AND FEATURES OF MY INVENTION

It is an object and feature of my invention to provide a novel articulated water bed.

Another object of my invention is to provide a novel flotation mattress which is particularly suited for use in combination with articulated bed frame structures.

Yet another object of my invention is to provide a flotation mattress for use in combination with an articulated bed frame which is stronger and more durable, yet substantially as supple and flexible as conventional flotation mattresses.

It is a feature of my invention to provide a flotation mattress of the general character referred to above which includes an outer jacket of supple, flexible sheet plastic and a plurality of elongate, parallel bladders of like material slackly filled with water and arranged within and contained by the outer jacket.

A further object of my invention is to provide a mattress structure of the character referred to above in which the outer jacket and the plurality of bladders are dimensionally proportioned so that the jacket supports and limits or prevents stretching and distending of the bladders beyond their elastic limits.

Yet another feature of my invention is to provide a mattress of the general character referred to above wherein the bladders and the jackets are established of sheets of thin, supple and flexible plastic material having edge portions in lapped engagement with each other and thermally welded together by continuous lines of weld and a construction wherein the lines of weld in the jacket are offset and spaced from the lines of welds in the bladders whereby the portions of the jacket backing up and supporting the welds in the bladders are not interrupted and/or weakened by lines of welds.

It is an object of my invention to provide a novel flotation mattress of the general character referred to above which is such that when it is caused to break or bend by operation of its related articulated bed frame, and when certain portions of the mattress structures are elevated above other portions thereof, gravity induced displacement and/or flow of water within the mattress structure is limited and controlled so that sufficient volumes of water remain in the elevated portions of the mattress to afford desired body support and the displacement or flow of water to the lower portions of the mattress is insufficient to prevent the establishment of desired and sought after body support.

The foregoing objects and features of my invention will be fully understood and other objects of my invention will become apparent from the following detailed description of typical preferred forms and applications of my invention, throughout which description reference is made to the accompanying drawings.

DESCRIPTION OF THE DRAWINGS

FIG. 7 is a plan view of the top wall of the mattress jacket and of those portions of the side and end walls of the jacket formed integrally therewith;

FIG. 8 is a plan view of the bottom wall of the jacket and of the portions of the end and side walls formed integrally therewith;

FIG. 9 is an enlarged isometric view of one corner of the jacket;

FIG. 10 is an enlarged detailed sectional view taken on line 10—10 on FIG. 9;

DETAILED DESCRIPTION OF THE INVENTION

Figure 1:
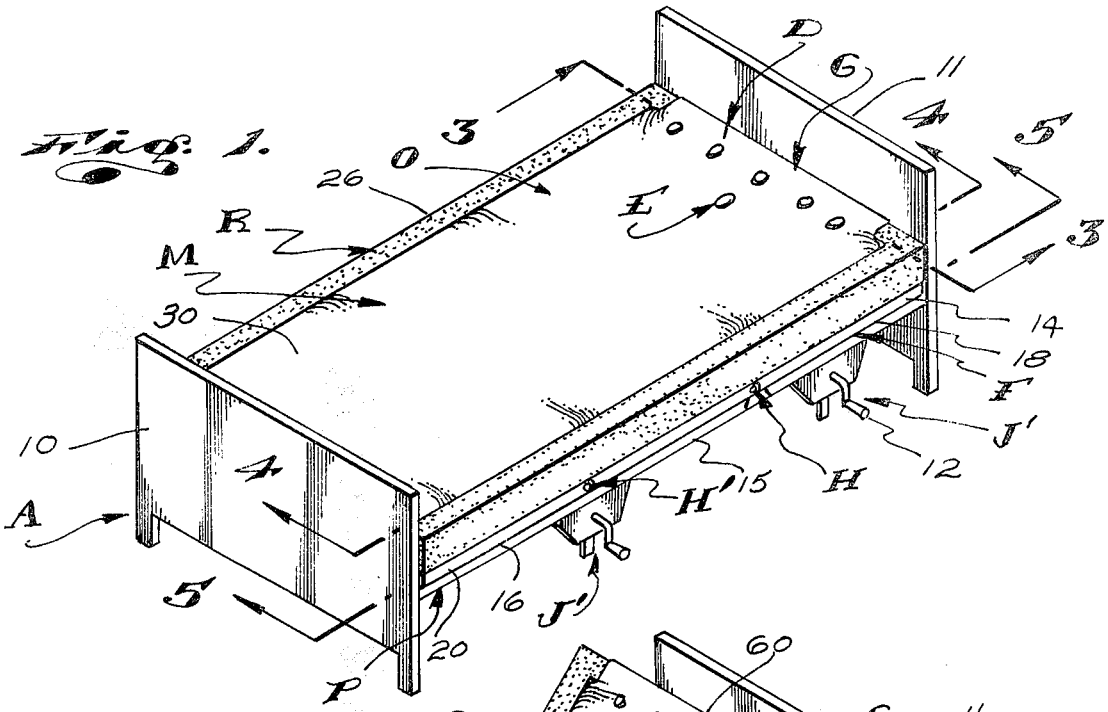
FIG. 1 is an isometric view of an articulated bed frame with my new flotation mattress structure related to it.

In FIGS. 1 through 5 of the drawings, I have shown an articulated bed structure A with a flotation mattress M and a mattress retainer R related to it.

The bed structure A is not illustrative of any known bed structure and is merely intended to show one typical combination and relationship of the basic parts that characterizes most articulated beds and with which my new mattress M can be advantageously related.

The bed structure A includes vertical, transversely extending foot and head boards 10 and 11 with floor engaging legs, a horizontal rectangular primary frame P fixed to and extending between the boards 10 and 11 in vertical spaced relationship above a related floor and a sectional articulated frame F above and supported by the primary frame P and supporting the retainer R and the mattress M. In addition to the above, the bed structure A includes two longitudinally spaced jack mechanisms J and J' carried by the primary frame P and suitably coupled with the frame F. The jack mechanisms J and J' are shown as manually operable mechanisms with hand cranks 12 accessible at the side of the bed frame structure A. In practice, the jack mechanism can be motor-driven, as desired.

In the structure A illustrated, the sectional articulated frame F is supported by the frame P and includes three longitudinally spaced sections, there being a forward head section 14, a rear foot section 16 and an intermediate or central section 15. The several sections 14, 15 and 16 are shown as being substantially equal in longitudinal extent; are rectangular in plan configuration and have straight, longitudinally extending side edges and straight, transversely extending front and rear or foot and head end edges. The head end edge of the central section 15 occurs adjacent an is pivotally connected with the foot end edge of the head section 14 and the foot end edge of the central section 15 occurs adjacent and is pivotally connected with the head end edge of the foot section 16.

In the case illustrated, the sections 14, 15 and 16 are shown including flat, horizontal, rectangular platforms 14', 15' and 16' of plywood and the like. The head end and side edges of the head section 14 are defined by angle iron frame members 17 and 18. The foot end and side edges of the foot section 16 are defined by angle iron frame members 19 and 20 and the side edges of the central section 15 are defined by angle iron frame members 21. The frame members 17 through 21 have outer vertical flanges which, in the case illustrated, project up from the top planes of their related platforms to establish retaining flanges for the retainer R. The related ends of the outer vertical flanges of the frame members 18, 20 and 21 establish lapped engagement with each other and are pivotally connected together by pivot pins 22 and 23. The pinned together portions of the frame members establish hinge means H and H' pivotally coupling the adjacent sections 14, 15 and 16 together, as clearly shown in the drawings. The pins 22 of the forward hinge means H are engaged in a plate-like bracket 24 whereby the hinge means H is held against vertical and longitudinal shifting relative to the primary frame P.

In common or conventional bed structures of the character here concerned with, the sections 14, 15 and 16 include metal frames within which bed springs comprising flat inner net works of wire links and pluralities of coil springs about the net works and engaging the frames, are arranged. Accordingly, the frame F which I have elected to illustrate is a different or novel frame with which my new mattress structure can be effectively related.

The jack mechanism J is shown related to and is suitably connected with the head section 14. The mechanism J is operable to pivot the section 14 upwardly and forwardly relative to the hinge means H, frame P and the central section 15, as clearly shown in the drawings. The jack mechanism J' is shown related to and is suitably connected with the section 15 (or 16). The mechanism J' is operable to pivot the foot end of the central section 15 upwardly and rearwardly relative to the hinge means H, the frame P and the section 14 and to thereby draw and move the foot section 16 forwardly and pivot it upwardly relative to the frame P and downwardly and forwardly relative to the hinge means H' and the central section 15, as clearly shown in the drawings.

In practice, the form and details of the bed construction thus far described can vary widely without adversely affecting or departing from the spirit of my invention.

Referring to FIGS. 1, 2, 3 and 4 of the drawings, the retainer R is a flat, horizontal rectangular unit coextensive with and overlying the top of the articulated frame F of the bed structure A in supported engagement therewith. The retainer R includes a normally flat horizontal rectangular panel 25 established of soft, flexible sheet plastic (or an equivalent material) and an upwardly projecting rectangular frame like weir 26 of soft, resilient and flexible foam plastic (or an equivalent material) about the perimeter of and projecting upwardly from the panel 25 and cooperating therewith to define an upwardly opening flotation mattress receiving and retaining basin X.

In the form of the invention illustrated, the panel 25 of the retainer has marginal extensions which are formed to extend about and to envelope the weir 26. With the weir 26 enveloped by integral extensions of the panel 25, the panel and the weir are integrated in a manner which effectively prevents lateral and/or longitudinal displacement of the weir relative to the panel 25 and to its related bed frame structure.

In practice, if desired, the panel 25 can be provided with an underlying layer of substrate of foam plastic.

It is to be noted that with the novel frame structure F that I have shown, the lower outside edges of the weir 26 are engaged by the vertical outside flanges of the frame members 17 through 21 of the articulated frame F whereby the retainer R is effectively retained in supported engagement atop the frame F.

The retainer R is sufficiently flexible so that when it is held down by the weight of the water-filled flotation mattress M engaged therein and when sections of the frame F are operated from their normal horizontal positions to elevated and broken positions, the retainer R bends and breaks to maintain uniform supported engagement with the frame F, as clearly shown in the drawings.

Figure 2:
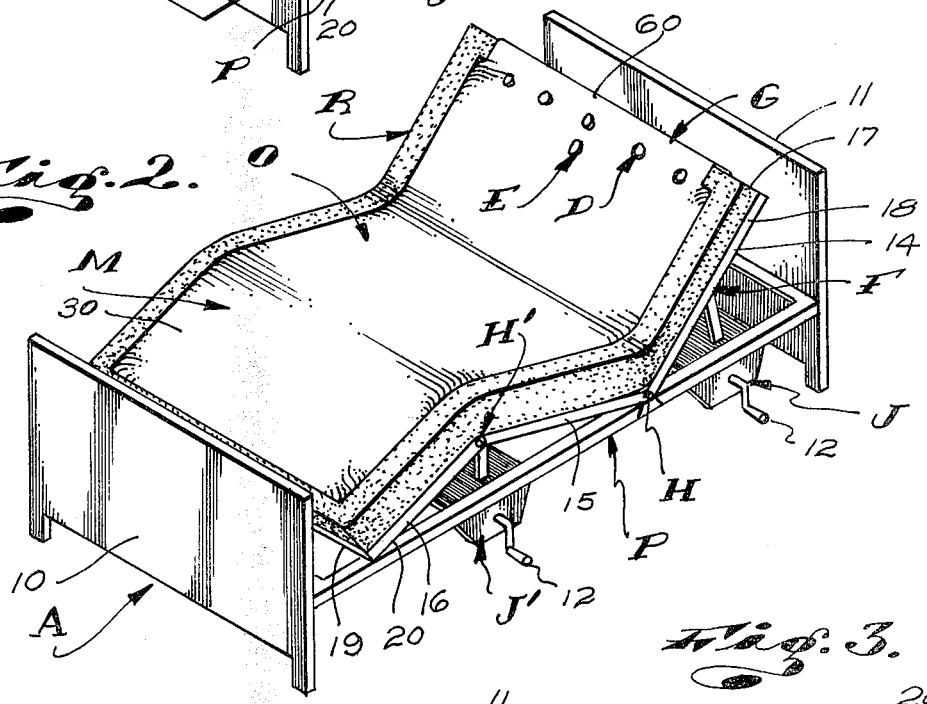
FIG. 2 is a view similar to FIG. 1 showing parts in different positions.
Figure 3:
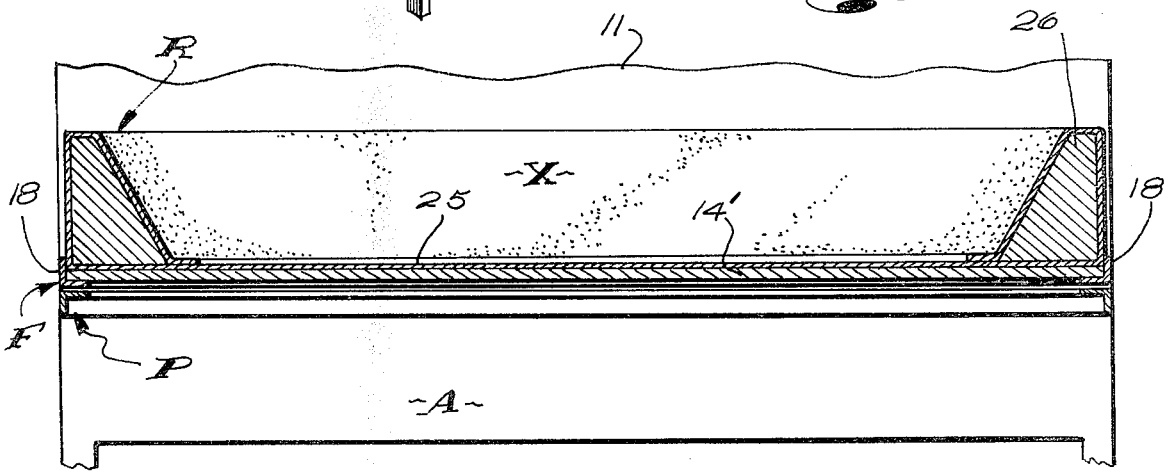
FIG. 3 is a sectional view of certain of the structure shown in FIGS. 1 and 2 and taken substantially as indicated by line 3—3 on FIG. 1.
Figure 4:
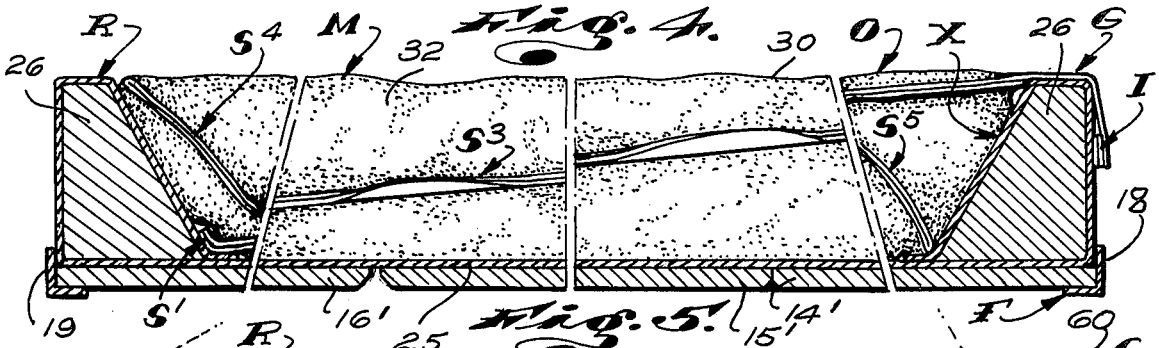
FIG. 4 is a sectional view of a portion of the structure shown in FIGS. 1 and 2 and taken as indicated by line 4—4 on FIG. 1.
Figure 5:
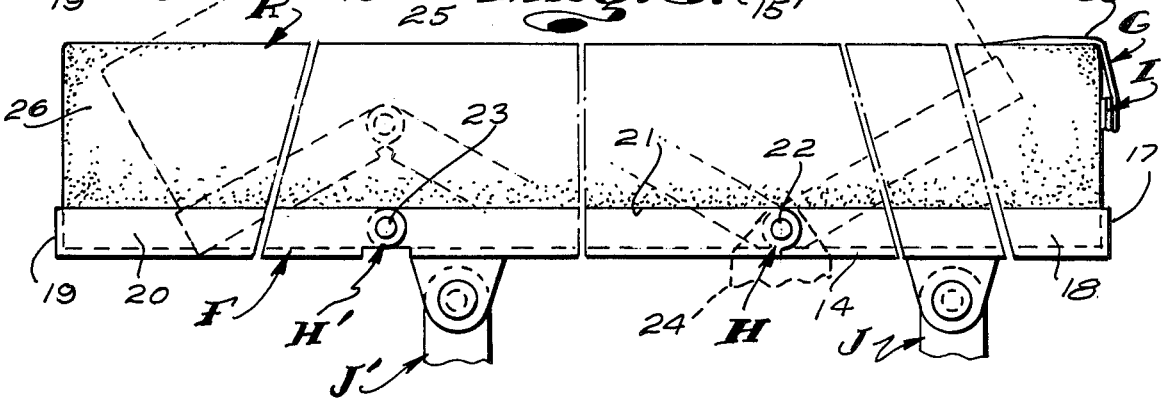
FIG. 5 is a view of certain of the structure shown in FIGS. 1 and 2 and taken substantially as indicated by line 5—5 on FIG. 1.
Figure 6:
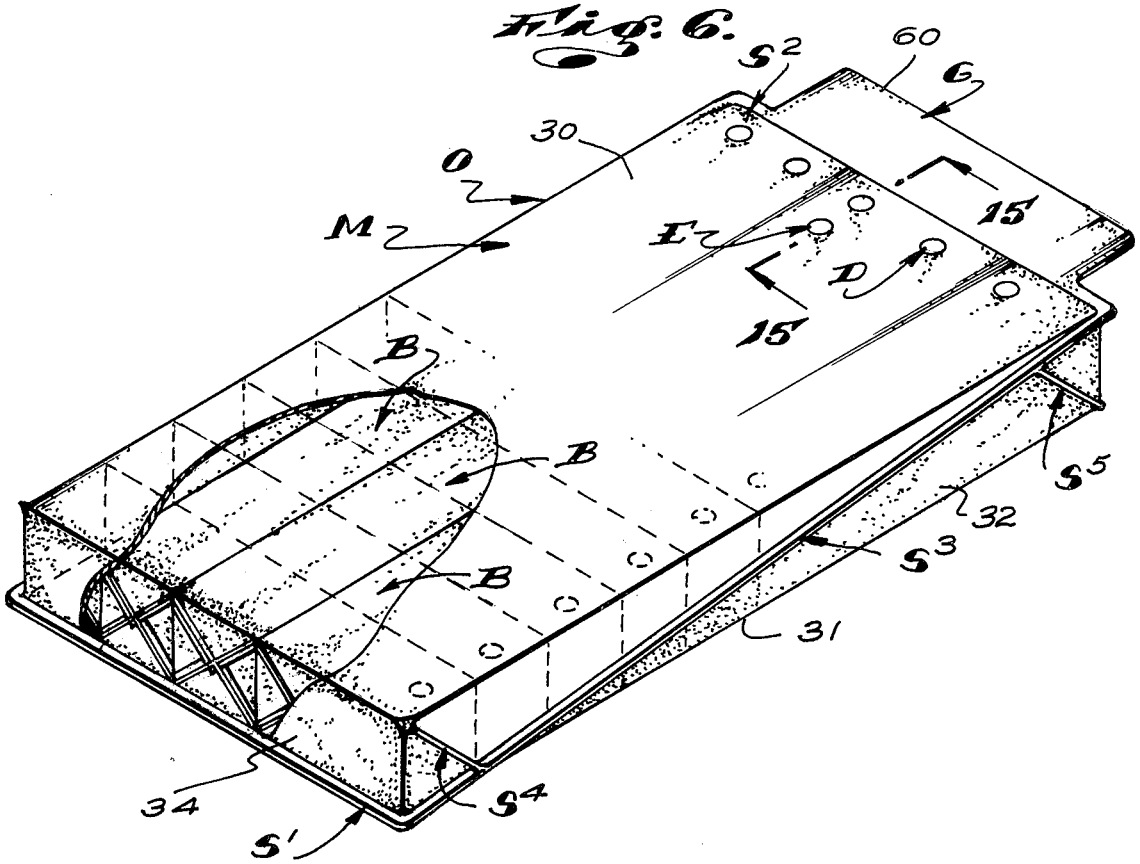
FIG. 6 is an isometric view of the flotation mattress structure that I provide.

Referring to FIGS. 1, 2 and 6 of the drawings the flotation mattress M is a flat horizontal rectangular unit substantially corresponding in plan configuration and in vertical extent with the basin X defined by the retainer R and is arranged within said basin X to be supported by the retainer 25 and retained by the weir 26 thereof.

The mattress M includes an outer jacket O of flexible, supple sheet plastic and a plurality of elongate parallel water filled bladders B, of similar sheet plastic arranged within the jacket O in captive retained engagement therein.

Figure 17:
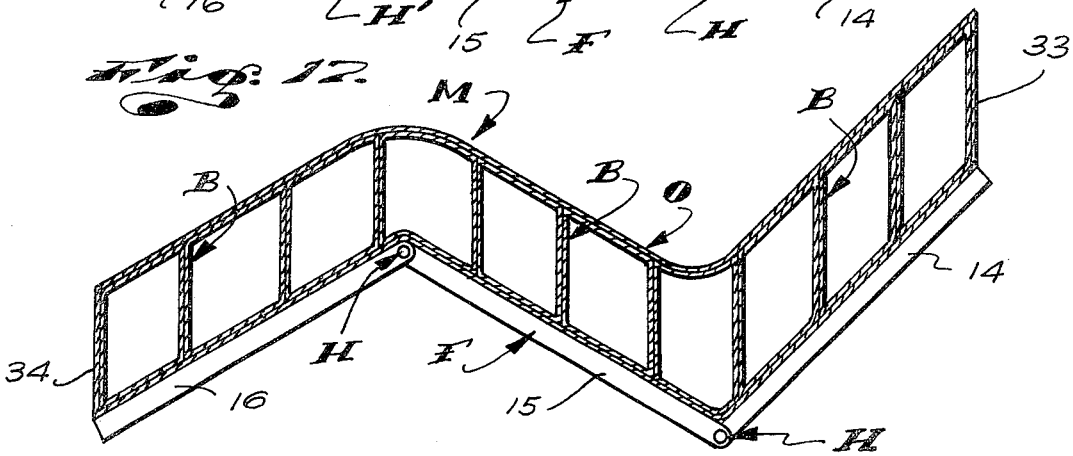
FIG. 17 is a view similar to FIG. 15 showing the structure in another position.

In practice, the plurality of elongate bladders B within the jacket O occur in side by side relationship with each other and can extend longitudinally of the jacket O, as shown in solid lines in FIG. 6 of the drawings, or can extend laterally of said jacket O, as shown in dotted lines in FIG. 6 of the drawings and in solid lines in FIG. 17 of the drawings.

The provision and use of laterally spaced longitudinally extending bladders B within the jacket O requires a lesser number of bladders B than is required if the bladders are spaced longitudinally and extend laterally of the jacket O and the ability to effectively heat the water in the several bladders by a single, laterally extending blanket-type resistance heater supported atop one of the platforms is made possible. For these reasons, such an arrangement of bladders is preferred.

While longitudinally extending bladders effect desired and effective control of displaced water within the mattress M when portions of the mattress are elevated and the mattress is broken along transverse lines, the provision and use of longitudinally spaced laterally extending bladders affords superior control of gravity displaced water within the mattress structure, when it is bent or broken as noted above. The superior control of water displacement within the mattress M afforded by a longitudinal series of laterally extending bladders is sufficiently great to make that arrangement highly desirable and such that it might be preferred by certain of those who will practice my invention.

The outer jacket O of the mattress includes and/or is characterized by normally flat vertically spaced horizontal rectangular top and bottom walls 30 and 31, vertical side walls 32 and vertical head and foot end walls 33 and 34. The jacket O is established of soft, supple and flexible sheet plastic, such as polyvinylchloride.

In the preferred carrying out of my invention, the top wall 30, one end wall, such as the foot end wall 34; and a portion of each side wall 32 are established of a first single sheet of plastic, cut substantially as shown in FIG. 7 of the drawings; while the bottom wall 31, the other or head end wall 33, and the other portions of the side wall 32 are established of a second single sheet of of like plastic cut substantially as shown in FIG. 8 of the drawings.

Referring to FIGS. 7 and 8 of the drawings, the lines L are the bend lines along which the sheet material is bent to define the corner edges between the several walls of the structure and the lines L' are the bend lines along which the sheet material is bent to define the four vertical corners of the jacket. The border portions S about the perimeter of the sheet in FIG. 7 of the drawings are those flange portions of that sheet which are arranged to occur in lapped engagement with related flange portions S of the sheet in FIG. 8 of the drawings and which are thermally welded together to establish the required seams in the jacket structure.

In the jacket structure illustrated, there is a seam S' along the junction of the bottom wall 31 and the foot end wall 34, a seam $S^2$ along the junction of the top wall 30 and the head end wall 33 and longitudinally upwardly and forwardly inclined seams $S^3$ extending diagonally of the side walls 32, from the lower corners of the foot ends to the upper corners of the head ends of said side walls. In addition to the seams $S^1$, $S^2$ and $S^3$, noted above, the foot end portions of the side walls 32 have downwardly and forwardly inclined seams $S^4$ extending from the upper foot end corners of the side walls to the seams $S^3$ and have downwardly and rearwardly inclined seams $S^5$ extending from the upper head end corners of the side walls to the seams $S^3$. The seams $S^1$, $S^2$ and $S^3$ are established by a single continuous thermal weld and the seams $S^4$ and $S^5$ include continuous thermal welds which join the welds of the seam $S^3$.

It is to be noted that the seams $S^2$ and $S^3$ at the ends of the jacket O extend longitudinally of their related upper and lower corner edges of the jacket and that they do not extend into or across the planes of their related vertical end walls. It is also important to note that the seams $S^3$ in the side walls 32 extend diagonally thereof so that they occur in close proximity to the mean or central horizontal plane of the jacket O at those longitudinally spaced points or stations of the jacket which occur above the hinge means H and H' of the frame F which supports the mattress M is caused to bend or break by operation of the frame F, the portions of the seams $S^3$ at the bend or breaks in the mattress occur substantially at or in sufficient close relationship to the mean horizontal plane of the mattress that they are substantially unstressed longitudinally of the construction.

It is also to be noted that if the portions of the seams $S^3$ occurring at the bends or breaks imparted into the mattress were spaced a substantial distance radially outward from the mean horizontal plane of the mattress structure, the seams would be subjected to substantial and potentially damaging tensile forces and would interfere and adversely affect bending or breaking of the mattress. Also, if the seams $S^3$, occurring at about the bend or breaks imparted into the mattress, were spaced a substantial distance radially inward of the mean horizontal plane of the mattress at the bends or breaks therein, the seams would be subjected to increased compressive forces and would be subject to being distorted, crimped and worked in such a manner that work-hardening of the material would be accelerated and premature failure of the construction would result.

In accordance with the foregoing and in furtherance of my invention, it is an object and feature of the invention to provide a jacket structure of the general character described and illustrated wherein seams at the sides of the jacket are made to occur at or in close proximity with the central or mean horizontal plane of the jacket, at and about the transverse bend or break lines extending in and through the jacket. In accordance with the foregoing, it will be apparent that the seams $S^3$ can be made to extend along a number of different shaped lines to attain the above end and that the straight diagonal seam lines shown in the drawings and described above is but one simple and practical way in which the sought after end can be attained.

In practice, the jacket O can, for example, be from 4" to 8" in vertical extent, 48" wide and 80" long.

The dimensions of the basin X of the retainer R are essentially the same as the dimensions of the jacket O set forth above.

The bladders B can be substantially square in cross-section and are substantially equal or vary slightly greater in vertical extent than the vertical extent of the jacket O. Accordingly, in the example given, the bladders may be from about 4"×4" to about 8"×8" in cross-section.

Further, the bladders are substantially equal and may be slightly greater in longitudinal extent than the longitudinal extent of or than the lateral extent of the jacket O, depending upon the direction in which they extend within the jacket O. In accordance with the above, with the example given, the bladders are approximately 48" or 80" long.

If the bladders B are 80" long and arranged to extend longitudinally of the jacket O, six bladders are provided. If, on the other hand, the bladders B are 48" long and are arranged to extend laterally of the jacket, ten bladders are provided.

As shown in the drawings, the several bladders B are alike and each includes normally flat horizontal top and bottom walls 40 and 41, vertical side walls 42 and like vertical end walls 43.

Figure 11:
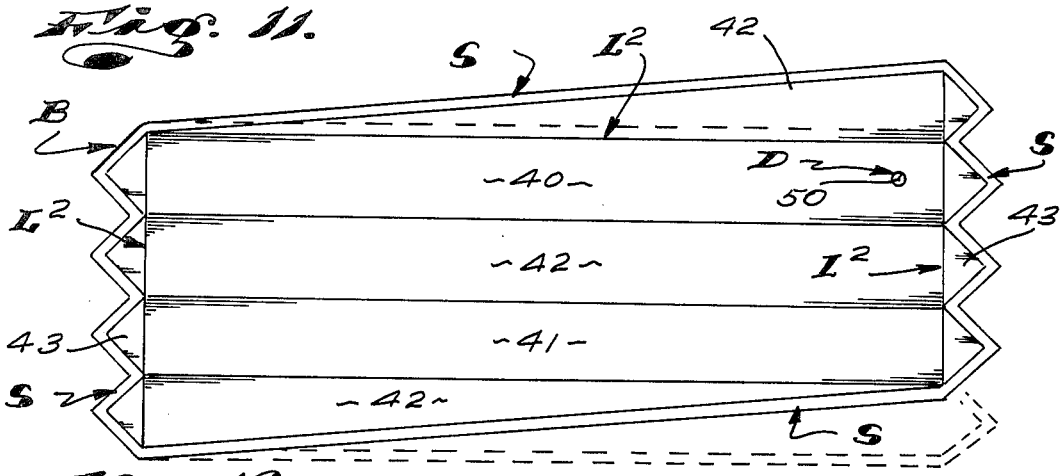
FIG. 11 is a plan view of a plastic sheet cut to establish a bladder of the mattress.

Each bladder B is preferably established of a single sheet of soft, supple and flexible plastic, such as polyvinylchloride, cut substantially as shown in FIG. 11 of the drawings. The lines $L^2$ in FIG. 11 of the drawings are the bend lines which define the 12 corner edges of the finished bladder and the border about the perimeter of FIG. 11 is the flange material which is provided to establish the required seams in the bladder.

Figure 12:
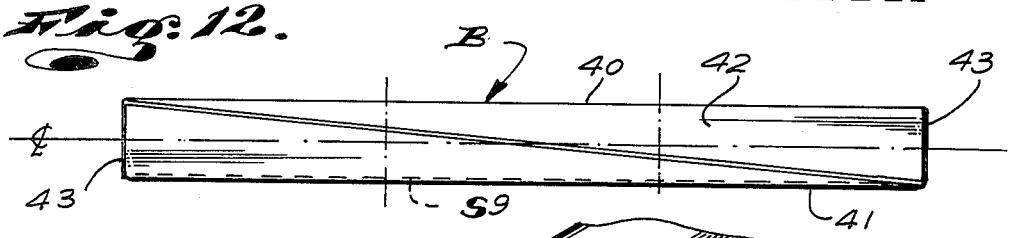
FIG. 12 is a side elevational view of a bladder.
Figure 13:
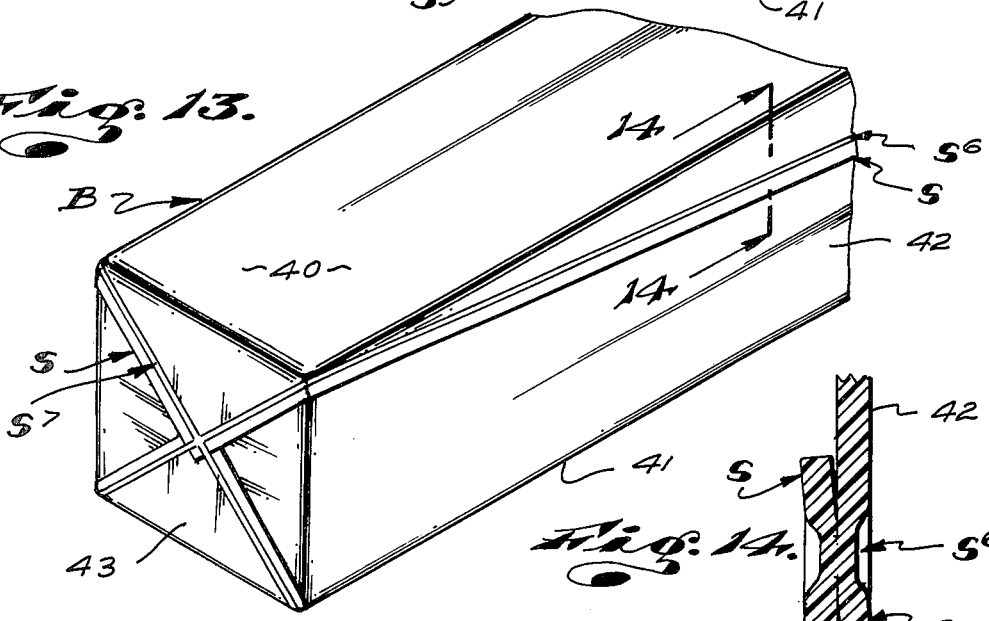
FIG. 13 is an enlarged isometric view of one end portion of a bladder.

Each bladder includes one longitudinally extending seam $S^6$ which seam can extend diagonally of one side wall 42 as shown in FIGS. 12 and 13 of the drawings. Such diagonal dispositioning of the seam $S^6$ is particularly desirable in the case where the bladders B are arranged to extend longitudinally of the jacket, for the same reasons that the seams $S^3$ in the jacket O are so inclined.

When the seams $S^6$ of the bladders extend longitudinally of the bladder and are inclined, as noted above, they are preferably inclined opposite with respect to the inclination of the seams $S^3$ of the jacket. This is, for example, rather than being inclined forwardly and upwardly as are the seams $S^3$, the seams $S^6$ are inclined forwardly and downwardly. With this relationship of parts, the seams $S^3$ in the jacket do not occur adjacent and run parallel with the seams $S^6$ of the adjacent bladders, but for the most part are spaced from the seams $S^6$ and occur on axes that only cross each other at one point intermediate the ends of the mattress construction.

The end walls 43 of each bladder are alike and each, for example, can be established of four suitably cut and formed flaps at the ends of the four longitudinally extending walls 40, 41 and 42; substantially as shown in FIG. 11 of the drawings.

The noted flaps are secured and sealed together by thermal welded seams $S^7$, as shown in FIG. 13 of the drawings.

With the bladder structure B noted above, when the plurality of bladders are arranged to extend longitudinally of the jacket, in side by side relationship, the side seam $S^6$ of each bladder which occurs adjacent another bladder is backed up and supported by the side wall of a bladder which is not interrupted and/or weakened by a welded seam. Further, the end walls 43 with their seams $S^7$ are backed up and supported by the head end and foot end walls 33 and 34 of the jacket O. The end walls 33 and 34 of the jacket are not interrupted and/or weakened by any welded seam and are such that they afford effective backing and reinforcement for the seams $S^7$ at the ends of the bladders.

In the case where the bladders B are arranged to extend laterally of the jacket O and are not subject to being bent or broken intermediate their ends, their longitudinal seams $S^9$ are preferably arranged to occur at and extend longitudinally of the lower edge of one of the side walls, as shown in dotted lines in FIGS. 11, 12 and 13 of the drawings. With such an arrangement, the side seams $S^9$ are not subject to appreciable working when the structure is in use.

In addition to the above, each bladder B is provided with a suitable water conducting filler fitting D to enable the bladder to be slackly filled with water. The jacket O is provided with an air evacuating or vent fitting E to allow air within the jacket to be vented therefrom when the bladders are filled and thereafter evacuated therefrom to draw and urge the jacket into substantial uniform engagement with the surfaces of the bladders which oppose it.

Figure 15:
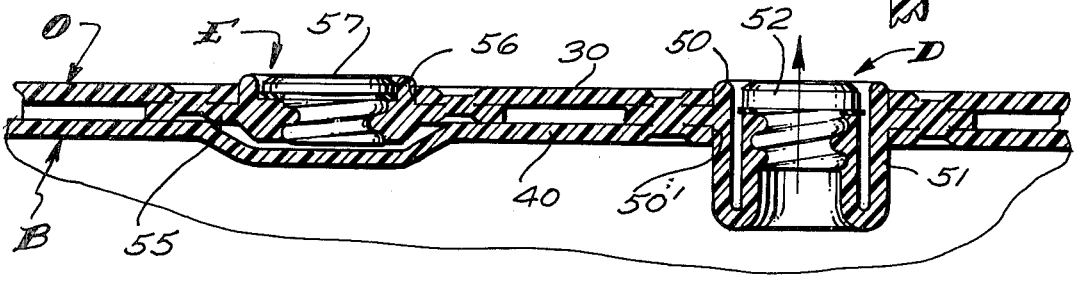
FIG. 15 is an enlarged detailed sectional view taken on line 15—15 on FIG. 6.

The filler fittings D and vent fitting E can vary widely in form. In FIG. 15 of the drawings, I have shown one form of fitting D and one form of fitting E that are satisfactory for carrying out my invention. The fitting D is sealingly engaged with and extends through an opening 50 provided in the top wall or the jacket O and an opening 50' provided in the top wall 40 of the bladder B, adjacent one end of the bladder. The fitting D includes an elongate flexible tubular neck 51 with a large diameter upwardly opening upper end portion and normally depending downwardly and into the interior of the bladder and an elongate lower end portion of reduced diameter which is turned upwardly into the upper portion and is normally closed by a removable plug 52. The neck 51 is such that the lower portion of the neck and its related plug 52 normally occur within the upper portion of the neck, below the top plane of the mattress and can be pulled vertically upwardly to project above the top plane of the mattress for convenient access to and removal of the plug 52 and for free access to the open free end of the neck when filling the bladder with water.

The vent fitting E shown in FIG. 15 of the drawings includes a simple disc-like body 55 sealingly fixed to the top wall 30 of the jacket O to overlie and/or project through an opening 56 provided in that wall. The body 55 has a central vertical through opening in which a suitable plug 57 is removably engaged. The fitting E is sufficiently flat and of limited vertical extent so that it is normally substantially flush with the top plane of the panel 30 and depends from that panel a limited distance so that it will not interfere or adversely affect the bladder B which occurs beneath it.

As the bladders B are slackly filled with water by introducing water into them through their fittings D, the fitting E is open to allow air within the jacket to be displaced therefrom. When the several bladders are filled and the fittings D are plugged and sealed and before the fitting E is plugged and sealed, excess air can be evacuated from within the jacket to cause the jacket to move into intimate contact with and about the bladders and to eliminate pockets of free air within the jacket which might migrate about and adversely affect the construction.

In practice, and to assure desired free relative movement of the bladders B relative to each other and relative movement between the jacket and the bladders, the exterior surfaces of the bladders and the interior surfaces of the jacket can be coated with a suitable lubricant such as talcum powder, a suitable silicone lubricant, or the like.

Finally, the mattress M can be provided with an anchoring means G at the head end of the jacket O to releasably anchor that end of the mattress to the retainer R or to the frame F, to prevent the mattress from shifting or moving axially toward the foot end of the frame F and the retainer R when its head end is elevated by the frame F, as shown in FIG. 2 of the drawings.

The anchor means G is shown as including a longitudinal extension 60 on the top wall 30 of the jacket O. The extension 60 is engaged over and down the outside of the head end of the retainer R. The lower free end portion of the extension is releasably secured to the retainer by suitable fastening means I. The fastening means I preferably includes a first strip of fabric with a looped pile fixed to one part, for example, to the extension 60, and a second strip of fabric with a hooked pile fixed to the other of said parts, or retainer, and releasably engaging the looped pile of the first strip. The above noted form of fastening means is that form of fastening means which is sold under the tradename "Velcro".

With the construction described above and shown in the drawings, when the mattress is bent or broken transversely by pivotal movement of the sections of the articulated frame F and by operation of the jack means J and/or J', increased internal hydraulic pressures in the bladder tend to cause the bladders to stretch and to expand. If such expansion and stretching of the bladders is unchecked, the bladders are subject to and are likely to rupture or burst at their weakest points, that is, adjacent to one or more of their thermally welded seams.

With the construction that I provide, the jacket O about the bladders securely holds and backs up the bladders when they are caused to expand by increased internal hydraulic pressures. More particularly, the jacket O directly backs up and supports the seams of the bladders which it engages and prevents these seams or the plastic sheet stock adjacent to the seams from stretching or being distended to or beyond its elastic limits.

Figure 16:
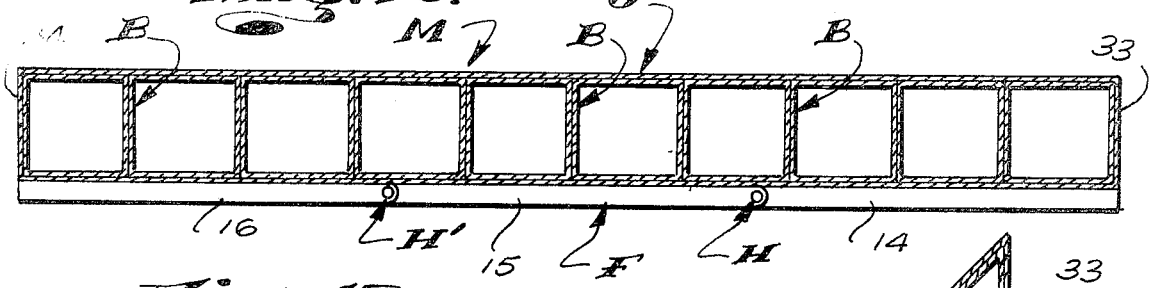
FIG. 16 is a diagrammatic longitudinal sectional view of a portion of the construction that I provide.

In the form of my invention when the bladders are arranged longitudinally of the jacket to extend transversely thereof, as shown in dotted lines in FIG. 6 of the drawings and as shown diagrammatically in FIGS. 16 and 17 of the drawings, when the mattress structure is bent or broken along transverse lines by pivoting and elevating portions of the mattress, upper or elevated bladders are supported or held up by their next adjacent lower bladders and the volumes of water at and occurring at various longitudinally spaced portions of the mattress structure remain substantially constant. That is, there does not occur a gravity induced flow and displacement of water from the elevated portions of the mattress down to the lower portions of the mattress; which displacement of water would tend to cause the upper or elevated portions of the mattress to be left with insufficient water to afford desired conforming of the elevated portions with portions of a person's body engaged therewith, or the over-filling and/or inflating of the lower portions of the mattress, by displaced water, which would prevent the lower portions of the mattress from satisfactorily conforming to portions of a person's body engaged therewith.

In the above considered embodiment of my invention, each bladder B is slackly filled with water to the extent that each bladder affords independent desired conforming support of a portion of a person's body engaged therewith. That is, the support afforded by each bladder is substantially independent of the support afforded by each of the other bladders and yet, the several bladders cooperate with each other to provide substantially uninterrupted uniform support of a single body atop the mattress and having portions in supported relationship with a plurality of all of the bladders.

Figure 18:
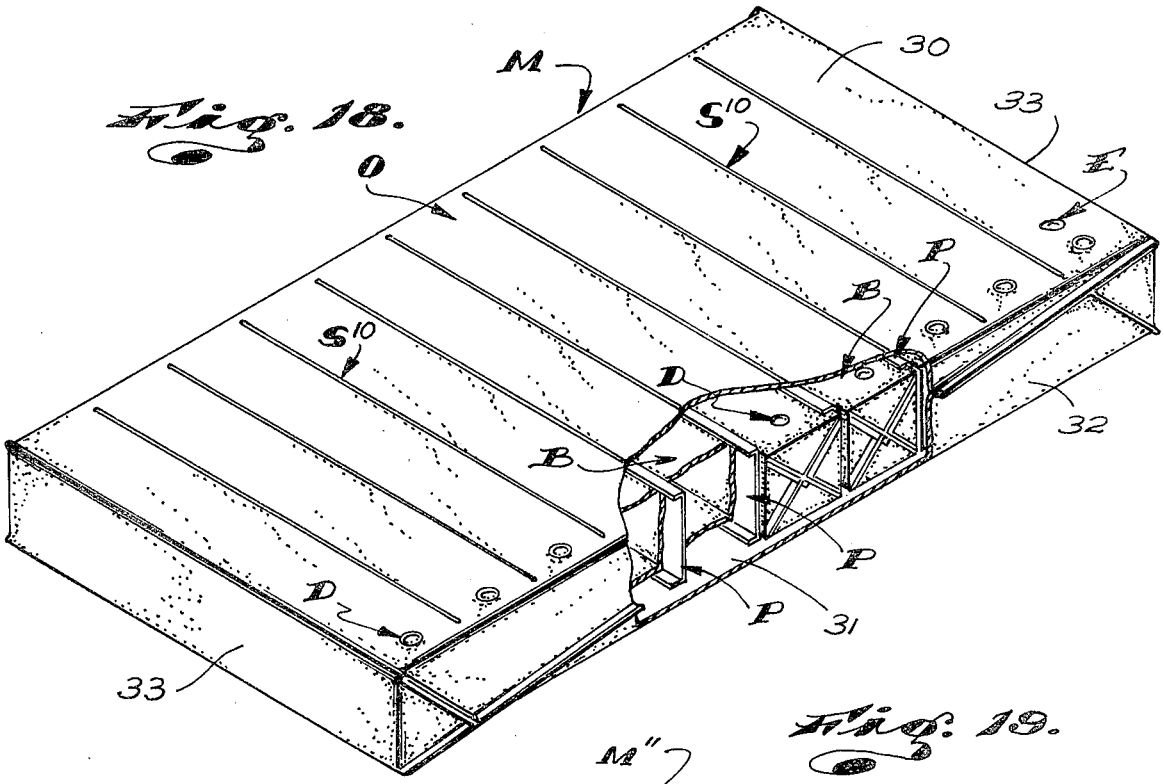
FIG. 18 is an isometric view showing another form of my invention and having portions broken away to better illustrate details of the construction.
Figure 19:
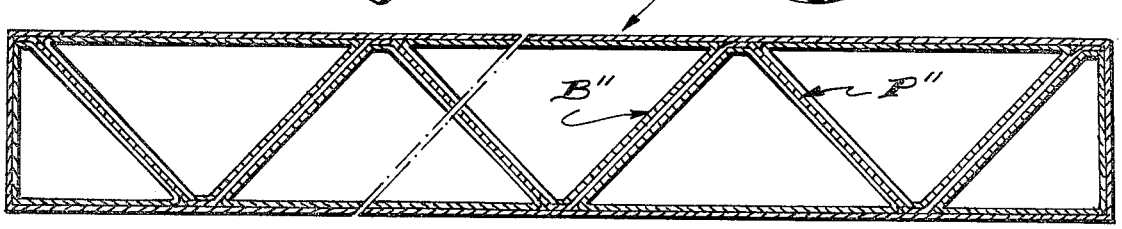
FIG. 19 is a view showing another embodiment of my invention.

In practice, due to the shape and relative proportioning of the jacket and the bladders and due to the inherent slack and flexibility of the mattress structure, there exists a tendency for the adjacent bladders to slide and/or shift over and under each other in such a manner that they may become so displaced that the mattress is rendered ineffective. That is, there may be a tendency for the bladders to shift down from elevated portions of the mattress and to gather together at the lower portions of the bent or broken mattress structure. If, if any mattress embodying my invention, the above undesirable shifting of the bladders is to be guarded against, the jacket O can be and is preferably provided with flat, vertical partitions P between each adjacent bladder B, as clearly shown in FIG. 18 of the drawings. The partitions P are established of strips of the same sheet plastic stock employed to establish the jacket and the bladders. The partitions P having upper and lower flanges welded to their related top and bottom walls 30 and 31 of the jacket, as illustrated at $S^{10}$ in FIG. 18 of the drawings.

With the partitions P noted above, the bladders B are effectively held against displacement in the jacket. Additionally, the partitions P afford reinforcement of the jacket structure and supplemental support of the bladders.

Figure 14:
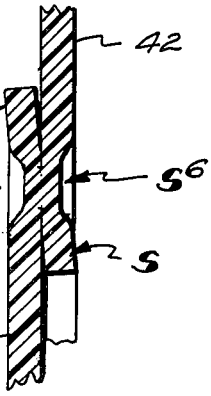
FIG. 14 is an enlarged detailed sectional view taken substantially as indicated by line 14—14 on FIG. 13 of the drawings.

In FIGS. 10 and 14 of the drawings, I have shown two basic forms of welded seams commonly employed in the establishment of water bed mattresses. The seam S shown in FIG. 10 and which has been shown employed in the jacket O is referred to as a butt seam, while the seam $S^6$ shown in FIG. 14 of the drawings and which has been shown employed in the bladder B is referred to as a lap seam. In practice, lap seams are stronger and are used when such seams can be effectively established. Butt seams are, as a general rule, employed in those situations where lap seams cannot be effectively established.

It is to be noted that the welds in the seams S and $S^6$ results in a reduction of the wall thickness of the sheet plastic stock at the seam (at both sections of the weld line). It is this noted reduction in wall thickness that adversely affects and notably weakens the finished structure.

Having described only typical preferred forms and applications of my invention, I do not wish to be limited to the specific details set forth above but wish to reserve to myself any modifications and/or variations that may appear to those skilled in the art and which fall within the scope of the following claims:

Having described my invention, I claim:

1. In combination, an articulated bed structure including an elongate normally flat horizontal sectional mattress supporting frame, including longitudinally spaced mattress supporting sections, adjacent sections of the frame having transversely extending opposing edges, hinge means pivotally coupling the adjacent edge portions of adjacent sections of the frame together and jack mechanisms carried by the bed structure and coupled with certain of said sections to selectively pivot those sections upwardly and downwardly relative to their pivotally related sections, an elongate normally flat horizontal flotation mattress overlying the frame and in supported engagement with the sections, said mattress including an outer jacket of supple, flexible air and waterproof sheet plastic having normally horizontal substantially flat vertically spaced top and bottom walls and vertical side and end walls and a plurality of elongate bladders of supple, flexible and waterproof sheet plastic with top, bottom, side and end walls arranged within the jacket in parallel side-by-side relationship with each other and slackly filled with water, the dimensions of the related and assembled bladders being substantially the same as the dimensions of the jacket whereby the bladders are captively retained in assembled relationship and are reinforced by the jacket, against over inflation and distension when selected portions of the mattress are elevated above other portions thereof, a retainer to retain the mattress atop the frame, said retainer including an elongate rectangular flexible panel substantially coextensive with the frame and arranged between the bottom wall of the mattress and the frame sections and a rectangular weir of soft flexible and vertically bendable material about the perimeter of the panel and projecting upwardly about and engaging the side and end walls of the jacket, sufficient air being evacuated from within the jacket whereby the walls of the jacket establish substantial uniform contact with related opposing walls of the bladders, said jacket further including partitions extending between adjacent bladders and extending between the top and bottom walls of the jacket.

2. The combination set forth in claim 1 wherein the bladders are arranged with their longitudinal axes extending parallel with the longitudinal axis of the jacket.

3. The combination set forth in claim 1 wherein the bladders are arranged with their longitudinal axes extending transverse with the longitudinal axis of the jacket.

4. The combination set forth in claim 1 which further includes anchor means at at least one end of the jacket releasably securing the jacket to the adjacent end of the retainer weir and preventing the secured end of the mattress from shifting longitudinally of the retainer and away from said end of the weir.

5. The combination set forth in claim 1 which further includes a normally closed and sealed water conducting filter fitting sealingly engaged in and through one end portion of each bladder and in and through a wall of the jacket and a normally closed air vent fitting sealingly engaged in and through one wall of the jacket.

6. The combination mattress set forth in claim 1 wherein the bladders are substantially square in cross-section.

7. The combination set forth in claim 1 wherein the bladders are substantially triangular in cross-section and are arranged with leg sides of adjacent bladders in substantial parallel opposing relationship with each other.

8. The combination set forth in claim 1 wherein the bladders are substantially triangular in cross-section and are arranged with leg sides of adjacent bladders in substantial parallel opposing relationship with each other.

* * * * *